US008950450B2

(12) United States Patent
Hedaya

(10) Patent No.: US 8,950,450 B2
(45) Date of Patent: Feb. 10, 2015

(54) REVERSIBLE NESTED HANDBAGS

(75) Inventor: Steven A. Hedaya, New York, NY (US)

(73) Assignee: Mondani Handbags & Accessories, Inc., New York, NY (US)

( * ) Notice: Subject to any disclaimer, the term of this patent is extended or adjusted under 35 U.S.C. 154(b) by 519 days.

(21) Appl. No.: 13/297,922

(22) Filed: Nov. 16, 2011

(65) Prior Publication Data

US 2012/0125496 A1 May 24, 2012

Related U.S. Application Data

(60) Provisional application No. 61/415,443, filed on Nov. 19, 2010.

(51) Int. Cl.
*A45C 3/08* (2006.01)

(52) U.S. Cl.
CPC ..... *A45C 3/08* (2013.01)
USPC ..... 150/104; 150/113; 150/108

(58) Field of Classification Search
USPC ..... 150/104, 105, 108, 113
See application file for complete search history.

(56) References Cited

U.S. PATENT DOCUMENTS

| | | | | |
|---|---|---|---|---|
| 2,482,422 | A * | 9/1949 | Loew | 206/37.1 |
| 4,078,595 | A * | 3/1978 | Mittelmann | 150/112 |
| 4,989,656 | A | 2/1991 | Derfler | |
| 5,201,447 | A * | 4/1993 | Bumb et al. | 224/243 |
| 7,160,028 | B1 | 1/2007 | Linday | |
| 7,178,567 | B2 | 2/2007 | Mangano | |
| 7,293,635 | B2 | 11/2007 | Repke et al. | |
| 2002/0029831 | A1 * | 3/2002 | Pendergrass | 150/105 |
| 2006/0021684 | A1 * | 2/2006 | DeCoro, III | 150/105 |
| 2007/0163689 | A1 * | 7/2007 | Pace et al. | 150/105 |
| 2009/0056843 | A1 | 3/2009 | Mangano | |
| 2009/0065110 | A1 * | 3/2009 | Cassella | 150/104 |
| 2012/0261041 | A1 * | 10/2012 | Melamed | 150/113 |

* cited by examiner

*Primary Examiner* — Tri Mai
(74) *Attorney, Agent, or Firm* — Leason Ellis LLP

(57) ABSTRACT

A pair of nested handbags includes an outer handbag and an inner handbag that is contained within an inner compartment of the outer handbag. The outer handbag has a reversible body and thus offers two different appearances depending upon how the outer handbag is worn. The outer handbag includes first and second handles that are attached to the outer handbag is such a way that the handles have the same appearance when the outer handbag is worn in either the first or second appearance.

8 Claims, 4 Drawing Sheets

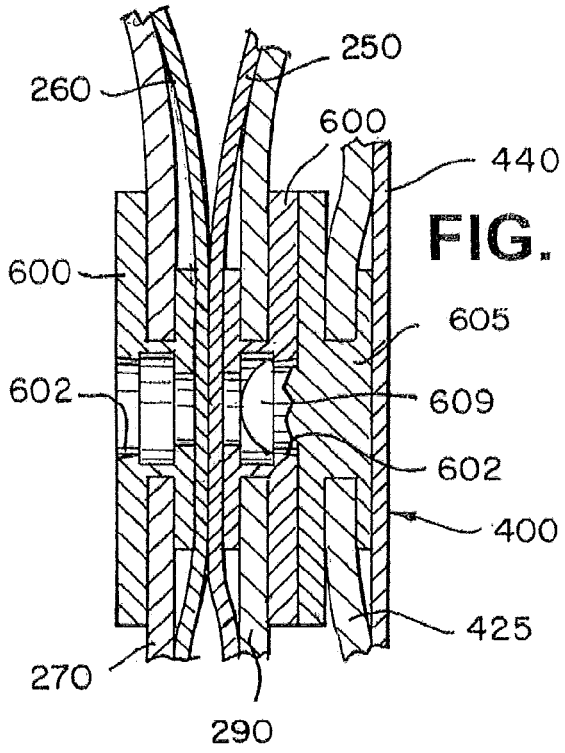
FIG. 3 A
FIG. 4 A
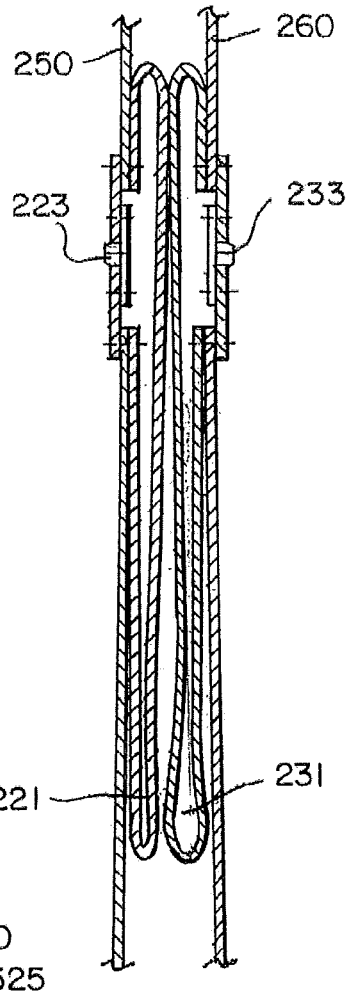
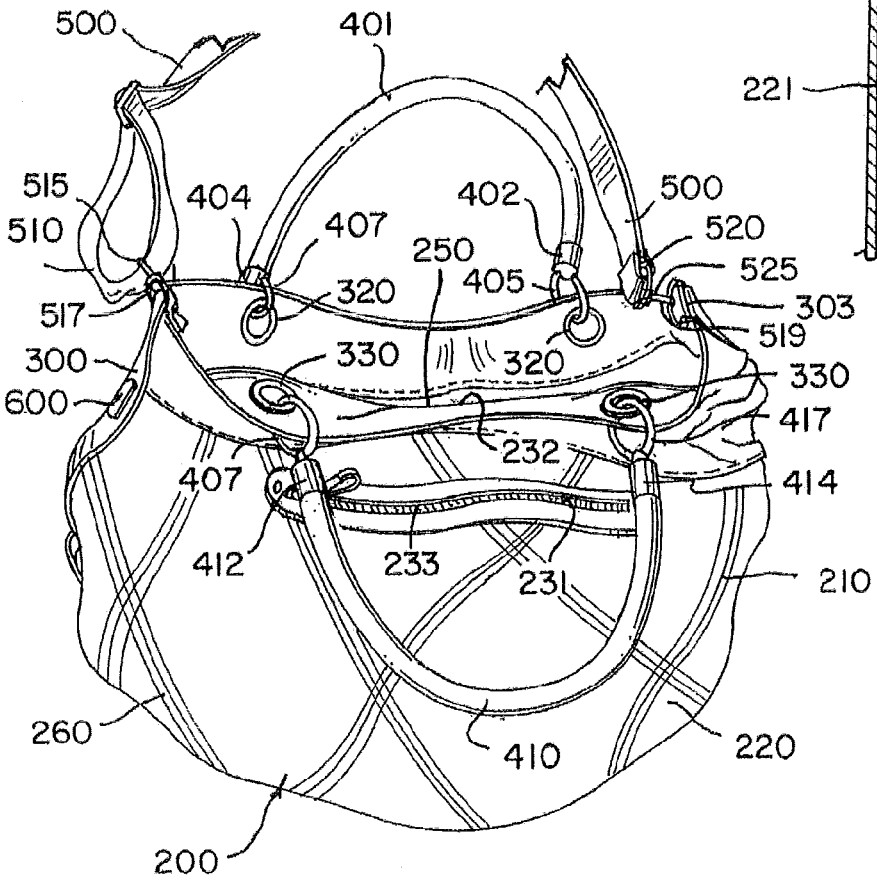
FIG. 5

REVERSIBLE NESTED HANDBAGS

CROSS REFERENCE TO RELATED APPLICATION

The present application claims the benefit of U.S. patent application Ser. No. 61/415,443, filed Nov. 19, 2010, which is hereby incorporated by reference in its entirety.

TECHNICAL FIELD

The present invention relates to fashion accessories and in particular, to a reversible handbag construction that includes a reversible outer handbag and an inner handbag with is securely, yet removably, attached to the outer handbag in either configuration.

BACKGROUND

As is well known, one of the more important accessories for a woman is a handbag since it is not only a functional item but also at the same time makes a fashion statement. The number of handbags available to the consumer is ever increasing since most fashion houses have their own line of handbags and there are a number of companies that specialize or focus on the manufacture of handbags. Also, designer handbags are increasingly more and more coveted by consumers as they have increasingly become more of a status symbol and define the current fashion trends.

It is therefore common for a woman to have a number of handbags in her collection since many of the handbags are intended for specific types of functions or uses. For example, most women have one or more everyday handbags that are carried to and from work and typically are sized to carry an agenda or the like as well as cosmetic products, a cell phone, etc. For more formal events or evening plans, a smaller, more formal style handbag is typically used. In addition, handbags are available in a great number of different shapes and sizes and moreover, handbags can be made from a number of different types of materials, such as exotic skins (alligator, etc.), suede, fabrics, smooth leather, textured leather, etc.

One type of handbag that has become more popular is a convertible or nested handbag in which an inner, removable handbag is wholly contained within an outer handbag. The outer handbag may belong to a set of differently styled similar units, and thereby, serve merely as a shell, providing a way to change the outer appearance of the combined unit, while not appreciably affecting the storage or organization of items within the inner handbag. Another advantage of the nested design is the possibility of using each member of the pair of handbags as a separate and independent entity.

There is a perceived need for an improved handbag that provides not only the advantages associated with a nested configuration but also provides other advantages that are associated with other handbag styles.

SUMMARY

In one embodiment of the present invention, a pair of nested handbags includes an outer handbag and an inner handbag that is contained within the outer handbag. The outer handbag is formed of a reversible body that includes at least first and second side pieces that are affixed to one another to define an interior compartment. The first and second side pieces each includes a top edge at which the interior compartment can be accessed. Each of the first and second side pieces includes a pair of handle openings formed therein. Each of the first and second side pieces includes a first face and an opposite second face. In a first wearing position, the first faces represent the inner faces contained within the interior compartment and in a second wearing position, the second faces represent the inner faces contained within the interior compartment. The first faces and the second faces have different appearances.

The inner handbag that is shaped and sized to be received and contained within the interior compartment of the outer handbag. The outer handbag includes a first handle that is coupled to the first side piece through the pair of handle openings formed therein. A second handle is coupled to the second side piece through the pair of handle openings formed therein. In each of the first and second wearing positions, the first and second handles have the same appearance relative to the body.

A first pair of first coupling members is attached to two ends of the outer handbag along the second faces thereof. A second pair of first coupling members is attached to the two ends of the outer handbag along the first faces thereof. The inner handbag includes a pair of second coupling members that are attached to the two ends of the inner handbag and are configured to interlocking mate with one of the first pair of first coupling members and the second pair of first coupling members, thereby permitting the inner handbag to be detachably connected to the outer handbag and contained within the interior compartment when the outer handbag is in either the first wearing position or the second wearing position.

These and other aspects, features and advantages shall be apparent from the accompanying Drawings and description of certain embodiments of the invention.

BRIEF DESCRIPTION OF THE DRAWINGS

FIG. 3A is a close-up of a local area of the handbags of FIG. 3;

FIG. 4A is a close-up of a local area of the handbags shown in FIG. 4; and FIG. 5 is a perspective view of the outer handbag of FIG. 1 in a reversed (inverted) condition.

DETAILED DESCRIPTION OF CERTAIN EMBODIMENTS OF THE INVENTION

Figure 1:
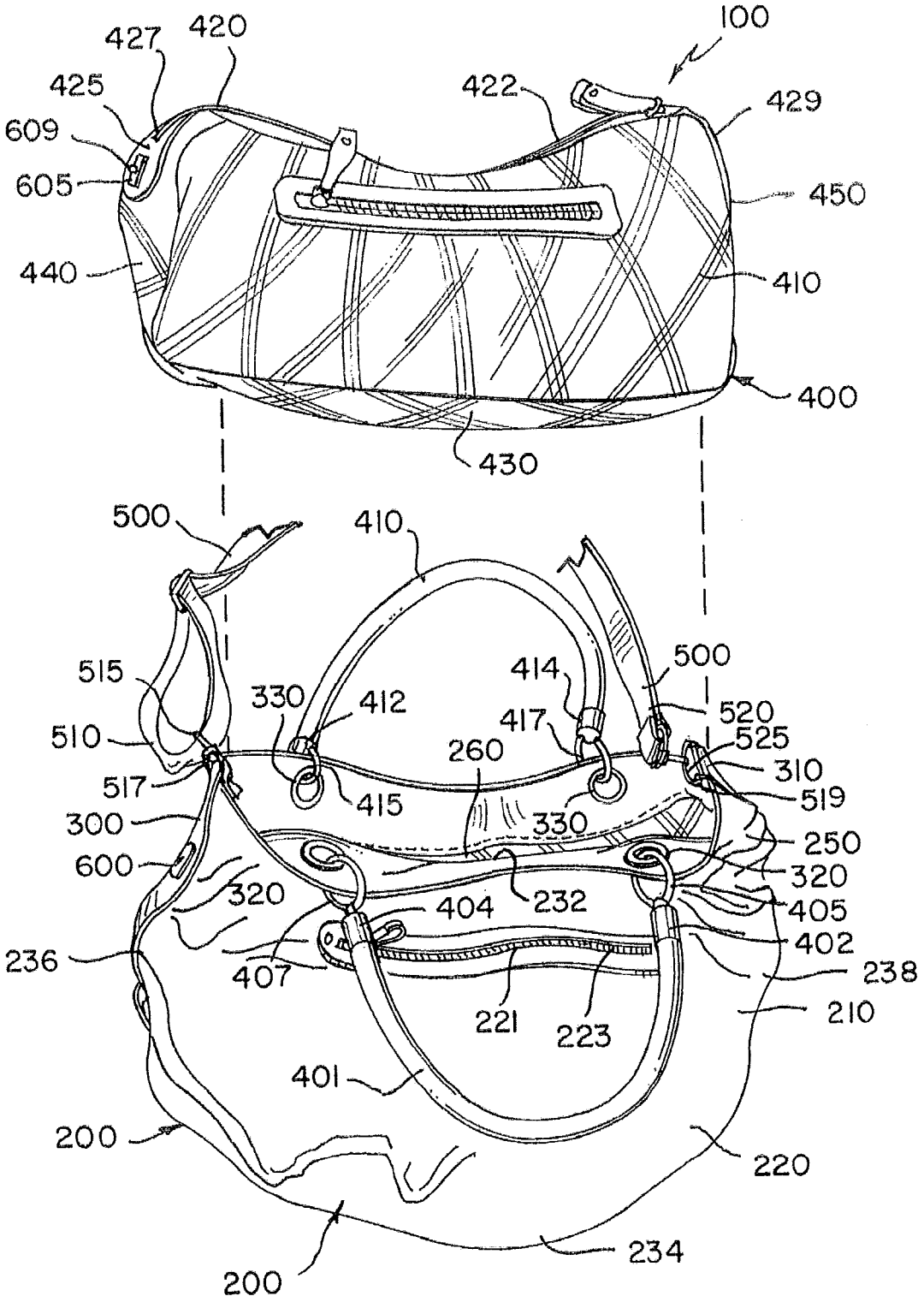
FIG. 1 is an exploded perspective view of reversible nested handbags according to one embodiment of the present invention.

In accordance with the present invention, a fashion accessory 100 is provided and is illustrated in FIGS. 1-5. The fashion accessory 100 is in the form of a pair of nested handbags including an outer handbag 200 and an inner handbag 400. It will be appreciated that the outer handbag 200 may belong to a plurality of similar outer handbags of various colors and stylistic varieties, while the inner handbag 400 which may come in any number of different forms and styles and storage configurations.

In accordance with the present invention, the outer handbag 200 is formed of a body 210 that includes a first side piece 220 and a second side piece 230 that are attached to one another as described herein to form the assembled outer handbag 200. The joined first and second side pieces 220, 230 define an interior compartment 240 that receives and stores items and in this case also receives and contains the inner handbag 400.

The first and second side pieces 220, 230 are generally rectangular shape and each includes a top edge 232, a bottom edge 234 and two opposing end edges 236, 238. The outer handbag 200 is assembled by attaching the first and second side pieces 220, 230 to one another about the peripheral edges thereof with the exception of the top edge 232 which is left open to permit access to the interior compartment 240. The first and second side pieces 220, 230 can be attached to one another using any number of different techniques, including stitching, etc.

Each of the first and second side pieces 220, 230 has a first surface 250 and a second surface 260. The outer handbag 200 is designed to be a reversible handbag that provides two different appearances depending on how the handbag is worn and therefore, in the first wearing or display position (FIG. 1), the first surfaces 250 represent the inner surfaces that define the interior compartment 240 and the second surfaces 260 represent the outer surfaces that face outward. In a second wearing or display position (FIG. 5) when the outer handbag 200 has been reversed (inverted), the second surfaces 260 represent the inner surface that define the interior compartment 240 and the first surfaces 250 represent the outer surface that face outward.

In the illustrated embodiment, the bottom edges 234 are attached to one another with stitching and include a first strap 270 that is attached with two rows of stitching to both the first side piece 220 and the second side piece 230 and more particularly are attached to the second surfaces 260 thereof. The first strap 270 has a first end 272 and an opposing second end 274 and as illustrated, the first strap 270 is not limited to being disposed along the bottom edge and at least partially extends up the two opposing end edges 236, 238 toward the top edge 232. The first end 272 has a first buckle 280 and similarly, the second end 274 has a second buckle 282.

The outer handbag 200 also includes a second strap 290 that is attached with two rows of stitching to both the first side piece 220 and the second side piece 230 and more particularly are attached to the first surfaces 250 thereof. The second strap 290 has a first end 292 and an opposing second end 294 and as illustrated, the second strap 290 is not limited to being disposed along the bottom edge (of the first surfaces 250) and at least partially extends up the two opposing end edges 236, 238 toward the top edge 232. The first end 292 has a first buckle 296 and similarly, the second end 294 has a second buckle 298.

It will therefore be appreciated that in the first wearing position, the first strap 270 is exposed, while in the second wearing position, the second strap 290 is exposed.

The outer handbag 200 also includes a third strap 300 that extends along the end edge 236. The third strap 300 is not attached to the body along its entire length but instead, the third strap 300 is only partially attached to the body. The third strap 300 actually extends along the end edge 236, with the second surfaces 260 facing outward, and is looped over the top edge 232 and then extends along the end edge 236 of the first surfaces 250. The third strap 300 has a first end 302 and an opposing second end 304, with the first and second ends 302, 304 being free ends that include openings (eyelets) to permit the prong of the respective buckle to be received therein. More specifically, the first end 302 is designed to mate with the buckle 280, while the second end 304 is designed to mate with the buckle 296.

At the top edge 232, the third strap 300 defined a loop 301 that is defined above the top edge 232.

The outer handbag 200 also includes a fourth strap 310 that extends along the end edge 238. The fourth strap 310 is not attached to the body along its entire length but instead, the fourth strap 310 is only partially attached to the body. The fourth strap 310 actually extends along the end edge 238, with the second surfaces 260 facing outward, and is looped over the top edge 232 and then extends along the end edge 238 of the first surfaces 250. The fourth strap 310 has a first end 312 and an opposing second end 314, with the first and second ends 312, 314 being free ends that include openings (eyelets) to permit the prong of the respective buckle to be received therein. More specifically, the first end 312 is designed to mate with the buckle 282, while the second end 314 is designed to mate with the buckle 298.

At the top edge 232, the fourth strap 310 defined a loop 303 that is defined above the top edge 232.

The body 210 can be formed of more than one material. For example, when the outer handbag 200 is a reversible handbag, the inner surface 260 can be formed of one material to give a first appearance, while the outer surface 250 is formed of a different material to give a second appearance that is different than the first appearance. In the illustrated embodiment, the inner surface 260 can be formed of a fabric material (e.g., plaid cloth) and the outer surface 250 can be formed of leather.

Figure 2:
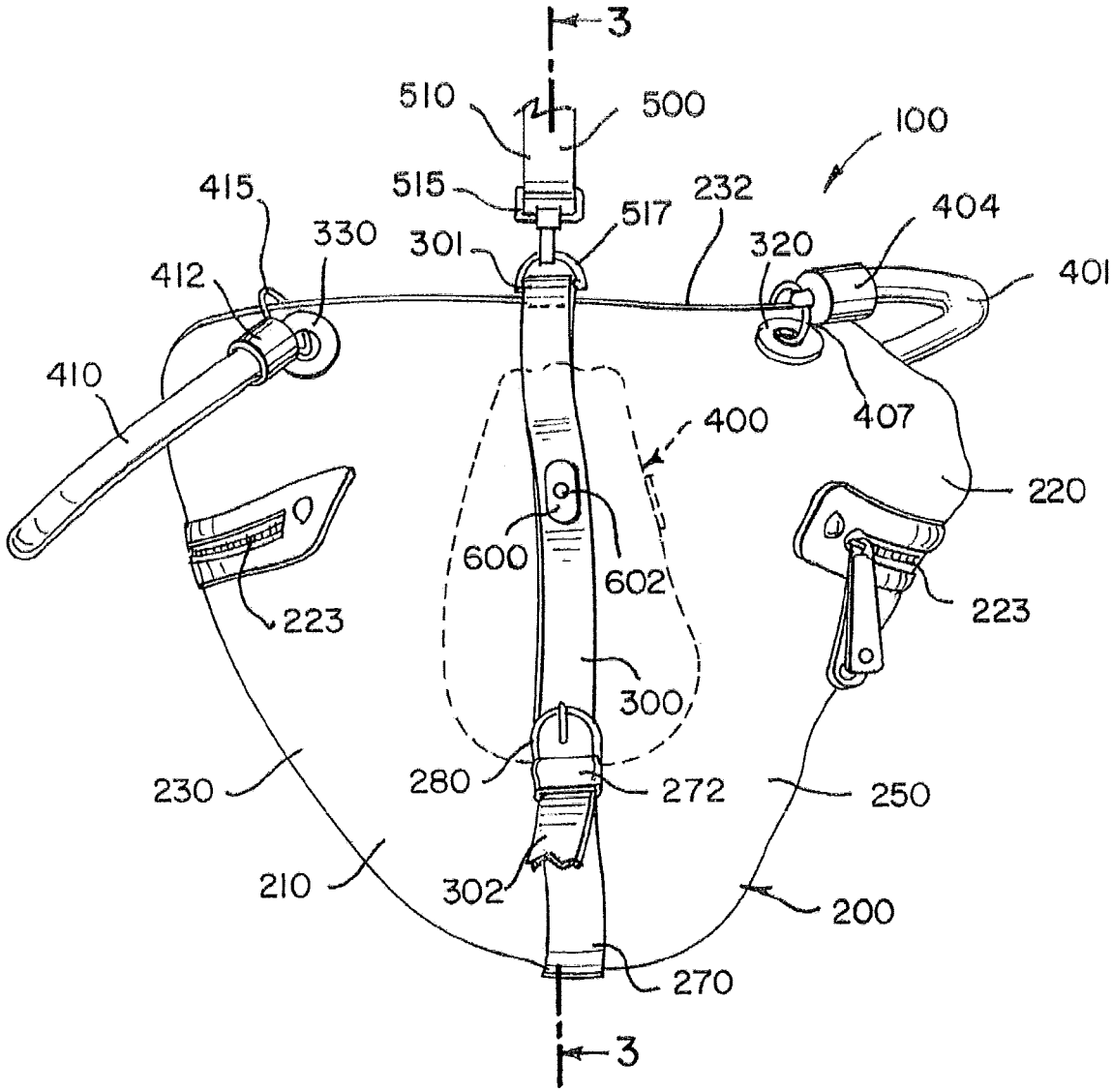
FIG. 2 is an end elevation view of reversible nested handbags according to the present invention.

The second surface 260 of the first side piece 220 includes a side pocket 221 that is accessible via a zipper 223. The second surface 260 of the second side piece 230 can be free of a pocket or alternatively, the second surface 260 of the second side piece 230 can include a side pocket as shown in FIG. 2. The first surface 250 of the first side piece 220 includes a side pocket 231 that is accessible via a zipper 233. The first surface 250 of the second side piece 230 can be free of a pocket or alternatively, the first surface 250 of the second side piece 230 can include a side pocket as shown in FIG. 2. The two side pockets 221, 231 are not accessible to one another even though they are located side-by-side.

The first side piece 220 includes a pair of spaced openings and metal rings 320 that are formed adjacent the top edge 232. Similarly, the second side piece 230 includes a pair of spaced openings and metal rings 330 that are formed adjacent the top edge 232. The metal rings 320, 330 are formed in the same locations in the respective side pieces 220, 230 such that when the outer handbag 200 is fully assembled and laid flat, the openings and metal rings 320, 330 are axially aligned with one another. The metal rings 320, 330 are fixed and not movable.

A first handle 401 is provided and includes a first end 402 and an opposing second end 404. The first end 402 is coupled to one metal ring 320, while the second 10 end 404 is coupled to the other metal ring 320. In the illustrated embodiment, the first end 402 includes a metal ring 405 that passes through the opening formed in the metal ring 320 to permit movement of the first handle 401. The second end 404 includes a metal ring 407 that passes through the opening formed in the other metal ring 320 to permit movement of the first handle 401. Similarly, a second handle 410 is provided 15 and includes a first end 412 and an opposing second end 414. The first end 412 is coupled to one metal ring 330, while the second end 414 is coupled to the other metal ring 330. In the illustrated embodiment, the first end 412 includes a metal ring 415 that passes through the opening formed in the metal ring 330 to permit movement of the second handle 410. The second end 414 includes a metal ring 417 that passes through the opening formed in the other metal ring 330 to permit movement of the second handle 410.

The first handle 401 and the second handle 410 are U-shaped.

The outer handbag 200 also includes an adjustable carrying strap 500 that has a first end 510 and an opposing second end 520. The first end 510 includes a clip 515 that can be detachably attached to a metal ring 517 that passes through the loop formed by the third strap 300 at the top edge 232 and similarly, the second end 520 that includes a clip 525 that can be detachably attached to a metal ring 519 that passes through the loop formed by the fourth strap 310 at the top edge 232.

As described herein, the outer handbag 200 is designed to be reversible in that the handbag body can be inverted and worn in either the first position (with the second surfaces 260 facing outward) and the second position (with the first surfaces 250 facing outward).

Due to the manner of attachment of the handles 401, 410 to the handbag body, the handles 401,410 have the same appearance irregardless of whether the handbag is in the first position or the second position. This offers advantages over conventional reversible (convertible) designs in which the handles have one appearance in one position and a second appearance in the other position when the handbag has been inverted.

In accordance with the present invention, the outer handbag 200 includes a plurality of first coupling members 600 that are configured and located to permit the inner handbag 400 to mate with and be releasably attached to the outer handbag 200. There are two pairs of first coupling members 600 to allow the inner handbag 400 to be releasably attached to the outer handbag 200 when the outer handbag 200 is positioned within either the first position or second position. The illustrated first coupling member 600 is in the form of a metal plate or tab that includes a center opening 602. The center opening 602 is a circular shaped opening. The illustrated coupling member 600 has a generally ovoid shape; however, the coupling members 600 can have any number of other shapes, including circular, square, rectangular, etc.

The first pair of first coupling members 600 is positioned along the two opposing end edges 236, 238 of the second surfaces 260 with the opening 602 being accessible. Similarly, the second pair of first coupling members 600 is positioned along the two opposing end edges 236, 238 of the first surfaces 250 with opening 602 being accessible.

In accordance with the present invention, the third and fourth straps 300, 310 are detached from the handbag body from the first coupling members 600 to the free ends 302, 304, 312, 314, of the third and fourth straps 300, 310, respectively.

The first and second pairs of coupling members 600 are located opposite one another on the two different surfaces of the handbag body.

Figure 4:
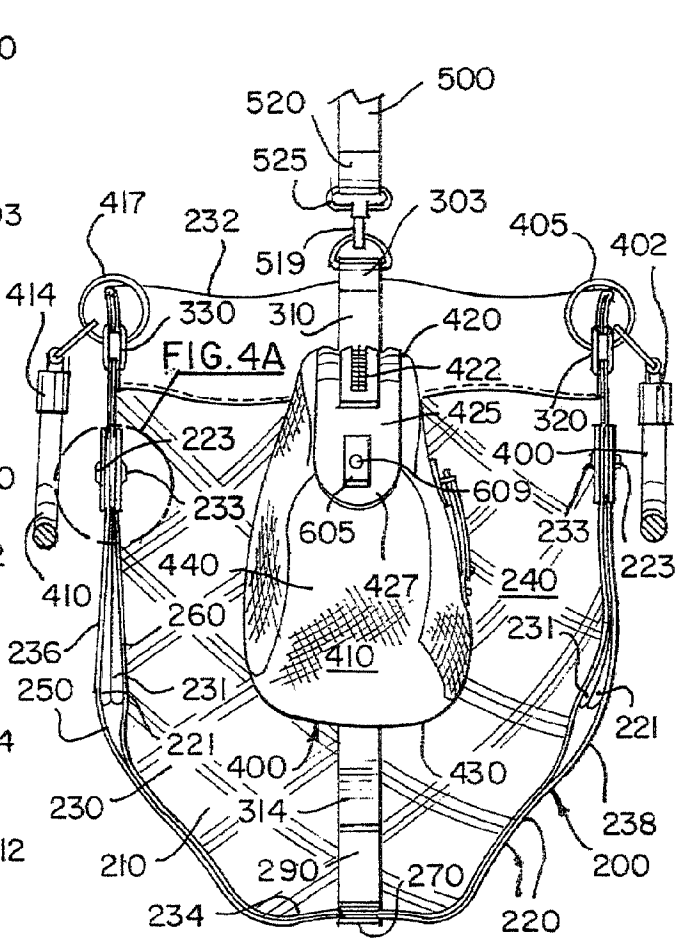
FIG. 4 is a cross-sectional view taken along the line 4-4 of FIG. 3.
Figure 3:
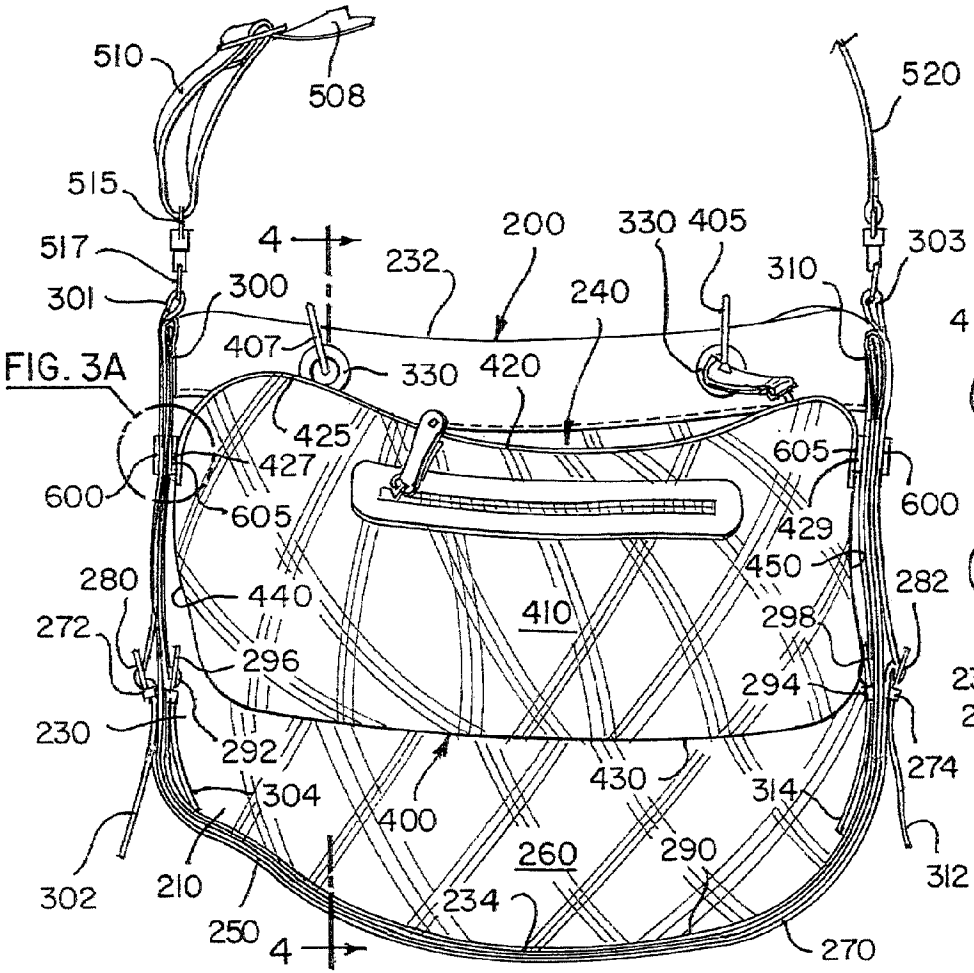
FIG. 3 is a cross-sectional view taken along the line 3-3 of FIG. 2.

Now referring to FIGS. 1 and 4, the inner handbag 400 is illustrated. The inner handbag 400 is formed of a body 410 that includes a top 420, a bottom 430, a first end 440 and an opposing second end 450. The top 420 includes a zipper 422 that provides access to an interior of the handbag 400 and is formed within a strap 425 that extends across the top 420 of the handbag 400. The strap 425 includes two ends 427, 429 and at each end, a second coupling member 605 is formed. The illustrated second coupling member 605 is in the form of a metal plate or tab that includes a protrusion 609. The protrusion 609 is circular shaped and is designed to snap-fittingly mate with the center opening 602 of the first coupling member 600 by being detachably received therein, thereby attaching the inner handbag 400 to the outer handbag 200.

The shape and size of the inner handbag 400 can vary so long as the inner handbag 400 can be received within the interior compartment of the outer handbag 200. It will be appreciated that the second coupling members 605 are configured to be received within the openings 602 to establish a mechanical fit (e.g., a snap-fit). The inner handbag 400 is not reversible and can be formed of a material that is the same as the material of the outer handbag 200 (either the first surface 250 or the second surface 260) or it can be formed of a material that is different. In addition, the appearance of the inner handbag 400 can be the same or different relative to the outer handbag 200. In the illustrated embodiment, the inner handbag 400 has the same print (plaid pattern) as the first surface 250 of the outer handbag 200.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A pair of nested handbags comprising:

an outer handbag that is formed of a reversible body that includes at least first and second side pieces that are affixed to one another to define an interior compartment, the first and second side pieces each includes a top edge at which the interior compartment can be accessed, wherein each of the first and second side pieces includes a pair of handle openings formed therein, each of the first and second side pieces includes a first face and an opposite second face, wherein in a first wearing position, the first faces represent the inner faces contained within the interior compartment and in a second wearing position, the second faces represent the inner faces contained within the interior compartment, the first faces and the second faces having different appearances;

an inner handbag that is shaped and sized to be received and contained within the interior compartment of the outer handbag;

a first handle that is coupled to the first side piece through the pair of handle openings formed therein;

a second handle that is coupled to the second side piece through the pair of handle openings formed therein, wherein in each of the first and second wearing positions, the first and second handles have the same appearance relative to the body;

a first pair of first coupling members that are attached to two ends of the outer handbag along the second faces thereof;

a second pair of first coupling members that are attached to the two ends of the outer handbag along the first faces thereof; and a pair of second coupling members that are attached to the two ends of the inner handbag and are configured to interlocking mate with one of the first pair of first coupling members and the second pair of first coupling members, thereby permitting the inner handbag to be detachably connected to the outer handbag and contained within the interior compartment when the outer handbag is in either the first wearing position or the second wearing position;

a first strap formed and attached along a bottom of the reversible body on the second faces thereof, the first strap having buckles at two ends thereof;

a second strap formed and attached along the bottom of the reversible body on the first faces thereof, the second strap having buckles at two ends thereof;

a third strap that extends up a first end of the reversible body on the second face thereof and extends over the top edge and down the first face at the first end of the reversible body, the third strap being attached to the reversible body along a length thereof and having a pair of free ends; and a fourth strap that extends up a second end of the reversible body on the second face thereof and extends over the top edge and down the first face at the first end of the reversible body, the third strap being attached to the reversible body along a length thereof and having a pair of free ends.

2. The pair of nested handbags of claim 1, wherein the handle openings formed in each of the first and second side pieces includes a reinforcement ring that is fixedly attached to the respective side piece and each end of each handle includes a ring that passes through one reinforcement ring.

3. The pair of nested handbags of claim 1, wherein the first side piece includes a first pocket that is accessible along an opening formed on the second face and a second pocket that is accessible along an opening formed on the first face, the first and second pockets being separated from one another.

4. The pair of nested handbags of claim 1, wherein one free end of the third strap is attached to one buckle of the first strap, while the other free end of the third strap is attached to one buckle of the second strap and similarly, one free end of the fourth strap is attached to one buckle of the first strap, while the other free end of the fourth strap is attached to one buckle of the second strap.

5. The pair of nested handbags of claim 1, wherein the third strap forms a loop at the top edge of the first end of the reversible body and the fourth strap forms a loop at the top edge of the first end of the reversible body.

6. The pair of nested handbags of claim 1, wherein two first coupling members are located along the third strap and two first coupling members are located along the fourth strap.

7. The pair of nested handbags of claim 5, wherein the third strap is detached and freely movable from each coupling member to the ends thereof and the fourth strap is detached and freely movable from each coupling member to the ends thereof.

8. The pair of nested handbags of claim 1, wherein the first coupling members comprise metal plates that each includes an opening formed therein and the second coupling members comprise metal plates that each includes a protrusion that is sized and shaped to be interlockingly, yet detachably, mated with a respective first coupling member by being received within the opening.

* * * * *